US008454272B2

(12) United States Patent
Kaarstad

(10) Patent No.: US 8,454,272 B2
(45) **Date of Patent: *Jun. 4, 2013**

(54) JACK-UP PLATFORM

(75) Inventor: Vemund Kaarstad, Oslo (NO)

(73) Assignee: Siemens Aktiengesellschaft, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/370,997

(22) Filed: Feb. 10, 2012

(65) Prior Publication Data

US 2012/0262099 A1 Oct. 18, 2012

Related U.S. Application Data

(63) Continuation of application No. 12/532,215, filed as application No. PCT/EP2007/002481 on Mar. 20, 2007, now Pat. No. 8,113,742.

(51) Int. Cl.
*E02B 17/08* (2006.01)

(52) U.S. Cl.
USPC ..... 405/196; 405/198

(58) Field of Classification Search
USPC ..... 405/196, 197, 198
See application file for complete search history.

(56) References Cited

U.S. PATENT DOCUMENTS

| | | | | |
|---|---|---|---|---|
| 4,269,543 | A | 5/1981 | Goldman et al. | 405/198 |
| 4,657,438 | A | 4/1987 | Gillis | 405/198 |
| 4,885,698 | A | 12/1989 | Kawasaki | 364/506 |
| 5,975,805 | A | 11/1999 | Morvan et al. | 405/198 |
| 6,952,705 | B2 | 10/2005 | Knoblock et al. | 707/103 R |
| 7,186,061 | B2 | 3/2007 | Foo et al. | 405/198 |
| 7,258,510 | B2 * | 8/2007 | Kawasaki | 405/198 |
| 8,113,742 | B2 * | 2/2012 | Kaarstad | 405/198 |
| 2002/0182014 | A1 | 12/2002 | Kawasaki | 405/196 |
| 2003/0004925 | A1 | 1/2003 | Knoblock et al. | 707/1 |
| 2005/0240605 | A1 | 10/2005 | Knoblock et al. | 707/100 |
| 2006/0062637 | A1 | 3/2006 | Foo et al. | 405/198 |
| 2008/0025799 | A1 | 1/2008 | Kawasaki | 405/198 |

FOREIGN PATENT DOCUMENTS

| | | | |
|---|---|---|---|
| EP | 0745729 | A1 | 12/1996 |
| GB | 2177978 | A | 2/1987 |
| WO | 2004/005129 | A1 | 1/2004 |
| WO | 2005/103391 | A1 | 11/2005 |

* cited by examiner

*Primary Examiner* — Frederick L Lagman
(74) *Attorney, Agent, or Firm* — King & Spalding L.L.P.

(57) ABSTRACT

A jack-up platform (1) has a hull (2) and at least three longitudinally movable support legs (3) for the hull (1), at least one of the support legs (3) has at least one variable speed drive (8, $\mathbf{8}_{A1}$ to $\mathbf{8}_{F2}$) as a part of a leg driving mechanism, wherein the platform (1) has a closed-loop control unit (7) for the driving mechanism, the closed-loop control unit (7) being connected with the variable speed drive (8, $\mathbf{8}_{A1}$ to $\mathbf{8}_{F2}$) via a bi-directional electronic bus (16) for transmitting control parameters (M*,M,N,R).

17 Claims, 3 Drawing Sheets

JACK-UP PLATFORM

CROSS-REFERENCE TO RELATED APPLICATIONS

This application is a Continuation of U.S. patent application Ser. No. 12/532,215 filed Sep. 21, 2009, now U.S. Pat. No. 8,113,742, which is a U.S. National Stage Application of International Application No. PCT/EP2007/002481 filed Mar. 20, 2007, the contents of which are hereby incorporated by reference in their entirety.

TECHNICAL FIELD

The invention relates to a jack-up platform.

BACKGROUND

Jack-up platforms typically comprise a hull and at least three longitudinally movable support legs. The support legs are individually movable relatively to the hull, i.e. can be lifted or lowered, using at least one driving mechanism. Usually, each leg has at least one separate driving mechanism on its own.

The lower ends of the support legs have to be put on a fixed ground for preparing the platform for service. For this purpose, the support legs are lowered until they touch the ground. Then the hull can be jacked to any arbitrary position above the ground by correspondingly driving the support legs which results in a movement of the hull. The support legs can be arranged in parallel or can be slant to improve stability of the jacked-up platform. The ground may have an inclined and/or uneven profile. In this case, the support legs are driven to different positions to keep balance of the hull.

For off-shore jack-up platforms, typically the hull is designed to be floatable in the maximally lifted state of the support legs. Thus, such a platform can be easily transported to its service location, e.g., by dragging it along the water surface using tugboats. When the platform reaches its service position, the support legs are driven down through the water until each of them touches the seabed. The hull can then be jacked up above the water level to increase the load onto the support legs for a stable standing of the platform. These platforms are usually applicable in waters of a depth of up to 150 m, but not in the deep sea.

Jack-up platforms of this kind are used, for example, in off-shore operations of the oil and gas industry for exploring or exploiting subsea gas and oil fields. In other words, they can be used as mobile gas or oil rigs. Other applications for off-shore jack-up platforms are, for example, maintenance works on subsea pipelines or other subsea lines as well as bed works in rivers or port basins.

An advantageous driving mechanism for jack-up platforms has been disclosed in WO 2005/103301 A1. There, permanently excited electric motors (also called "permanent magnet motors") have been proposed for moving the support legs and for holding the hull in a predetermined position above the ground, in contrast to induction motors used in prior art. This way, no mechanical brakes are needed for temporarily holding the platform, because the hull can be kept in position solely by the high-efficiency permanent magnet motors. Besides, the permanent magnet motors enable a movement of the support legs with infinitely variable speed, thus permitting smooth operations with high torque, in contrast to typical prior art with two-speed operation, high slip. However, no efficient way of controlling the driving mechanism has been disclosed so far.

SUMMARY

According to various embodiments, a jack-up platform can be specified offering high-performance and reliable support leg operations.

According to an embodiment, a jack-up platform may comprise a hull and at least three longitudinally movable support legs for said hull, at least one of said support legs comprising at least one variable speed drive as a part of a leg driving mechanism, wherein the platform comprises a closed-loop control unit for said driving mechanism, the closed-loop control unit being connected with said variable speed drive via a bi-directional electronic bus for transmitting control parameters, characterized in that said control unit comprises a speed controller which hands over a torque set-point to a torque controller of said variable speed drive via said bus connection.

According to a further embodiment, the variable speed drive may connect to a permanently excited motor. According to a further embodiment, the variable speed drive may connect to an induction motor. According to a further embodiment, said torque controller can be integrated into said variable speed drive. According to a further embodiment, said speed controller can receive an actual speed value of said variable speed drive via said bus connection. According to a further embodiment, a speed sensor validation module can be disposed upstream of said speed controller. According to a further embodiment, said speed sensor validation module may select a most probable correct speed value and/or a speed value of a highest-bandwidth sensor. According to a further embodiment, the closed-loop control unit may comprise a torque restriction module acting on said torque set-point output by said speed controller to said variable speed drive. According to a further embodiment, said torque restriction module can perform a combined torque/power limitation. According to a further embodiment, said torque restriction module can receive actual speed and actual torque values of said variable speed drive via said bus connection. According to a further embodiment, said closed-loop control unit may comprise one respective speed controller for each support leg. According to a further embodiment, at least one support leg driving mechanism may comprise more than one variable speed drive. According to a further embodiment, each variable speed drive of said multi-drive support leg may comprise one respective torque controller connected with the respective speed controller via said bus connection. According to a further embodiment, said bi-directional electronic bus can be a high-speed field bus or an Ethernet.

BRIEF DESCRIPTION OF THE DRAWINGS

In the following, embodiments are explained in further detail with drawings.

In the drawings.

Identical parts are denoted by same reference signs in all figures.

DETAILED DESCRIPTION

Figure 1:
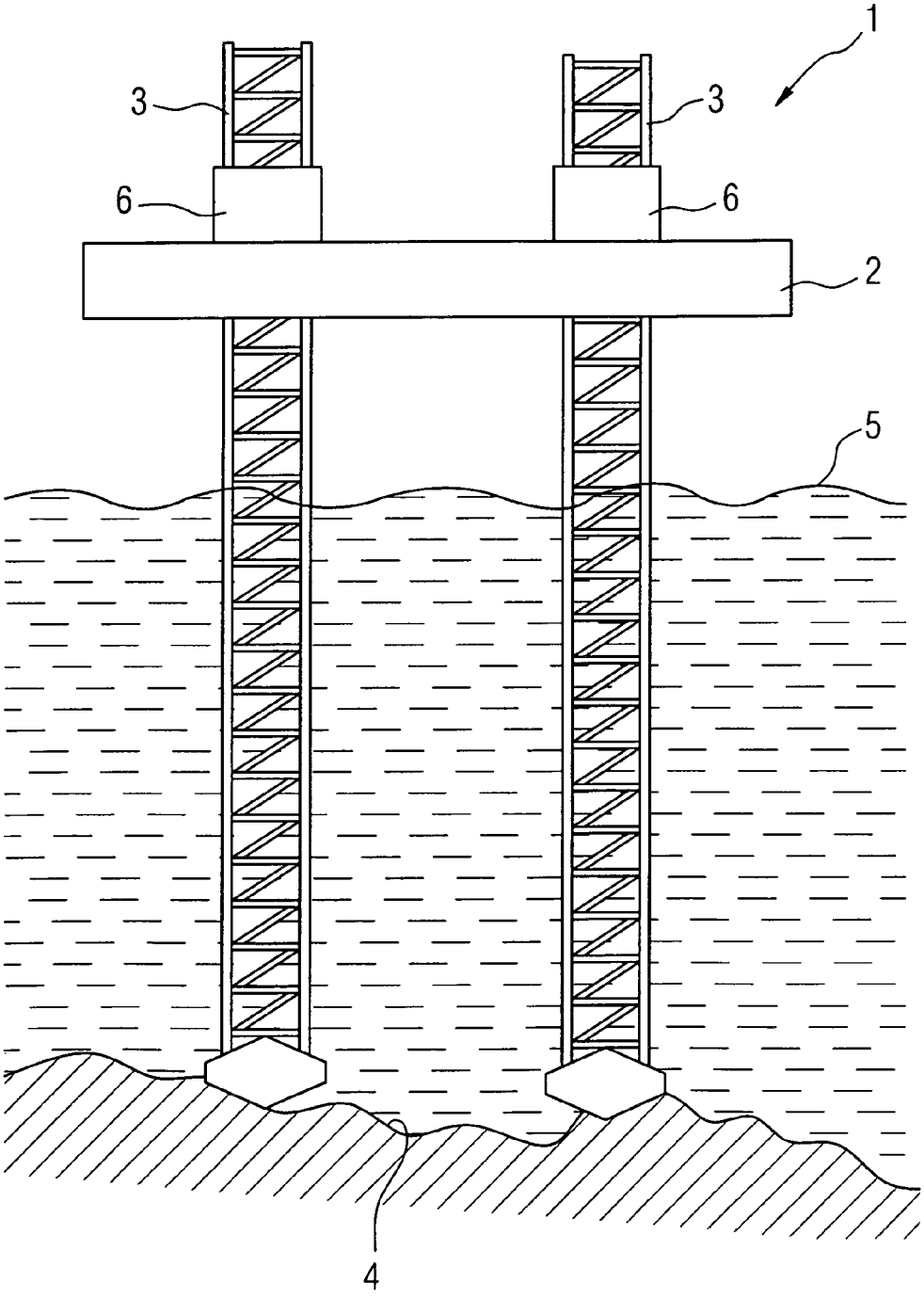
FIG. 1 shows a schematic side view of a jack-up platform.

According to various embodiments, a jack-up platform may comprise a hull and at least three longitudinally movable support legs for the hull. At least one of the support legs comprises at least one variable speed drive (VSD) as a part of a leg driving mechanism. The platform comprises a closed-loop control unit for this driving mechanism. The control unit is connected to the variable speed drive via a bi-directional electronic bus for transmitting control parameters. This means that the variable speed drive is integrated into the control system. This is achieved by the bi-directional electronic bus connection, e.g. a high-speed field bus or an Ethernet.

The electronic bus connection ensures that vital control parameters from the variable speed drive, such as actual speed and actual torque, can be used by the control unit and vice versa in a closed-loop control. On the one hand, this enables high performance support leg operations, because the available speed/torque can be fully utilised in a closed-loop control. On the other hand, a stable speed/torque control of the driving mechanism becomes possible. Besides, the variable speed drive enables movements with infinitely variable speeds even with induction motors.

Furthermore, the variable speed drive can control either an induction motor or a permanently excited motor. Preferably, the variable speed drive is connected to a permanently excited motor or a permanent magnet DC motor for driving said permanently excited motor at a variable speed. Permanent magnet motors are superior to induction motors regarding rotor losses when the elevated deck is in hold position. In this case, motor stresses and heat dissipation are especially reduced. In the latter case, individual inverters are required for each variable speed drive, if several motors are used.

Preferably, said control unit comprises a speed controller which hands over a torque set-point to a torque controller of said variable speed drive via said bus connection. This cascaded control structure allows for separating different module functions within the control unit. A speed set-point can be determined externally and input into the speed controller. Both the speed set-point and the torque-set point can be accessed between the modules, for example, for applying constraints such as a torque limitation. Therefore, the modules can work independently from each other, thus reducing the error-proneness of the control unit.

Advantageously, said torque controller is integrated into said variable speed drive. This way, the variable speed drive can be compact. Additionally, the variable speed drive controlled jacking system can be operated without personnel on deck, adding safety to operations.

In a preferred embodiment, said speed controller can receive an actual speed value of said variable speed drive via said bus connection. The actual speed value is a preferred operative control parameter for the closed-loop leg movement control.

The reliability and the accuracy of the leg movement operations can be increased by a speed sensor validation module disposed upstream of said speed controller. A control value and sensor validation can also be provided for any other control parameter, for example, actual torque values or weight values. During the critical jacking operation, a control value and sensor validation module can evaluate the status and values from each sensor. This evaluation can be based on a predefinable control strategy.

Preferred control strategies for said speed sensor validation module are, for example, to select a most probable correct speed value and/or a speed value of a highest-bandwidth sensor. The most probable correct value can be determined, for example, as a maximum, a mean, a low selection, or a calculated average from functional sensors. The highest-bandwidth for a speed value may be achieved, for example, by using a speed value directly from motor sensors rather than one calculated from position sensor values. By these control strategies, high reliability and accuracy of the jacking operation can be ensured.

In another advantageous embodiment, the control unit comprises a torque restriction module acting on said torque set-point output by said speed controller to said variable speed drive. The independent torque restriction module can realise external and internal constraints such as power limitations and operator-set limits. For example, a fixed or variable torque limit, optionally in addition to an effective current limit, can be imposed on the driving mechanism without interfering with the action of the speed and torque controllers. A result will be smoother transitions in jacking operations.

For this purpose, said torque restriction module advantageously can perform a combined torque/power limitation. A combined torque/power limitation according to an embodiment comprises limiting the speed controller's torque set-point by an internally or externally set torque limit during low-speed situations, and, during high-speed situations, limiting the torque-set point by a floating limit based on the available power on the platform.

Preferably, said torque restriction module can receive actual speed and actual torque values of said variable speed drive via said bus connection. Thus, the independent torque restriction module can realise external or internal constraints for the torque set-point by directly monitoring the variable speed drive. This ensures short reaction times and high reliability of the driving mechanism, as well as reduces mechanical wear and tear.

In a highly preferred embodiment, said control unit comprises one respective speed controller for each support leg. This allows for further decentralising the closed-loop control by distributing subtasks to different independent modules. However, in group operation of all support legs all speed controllers will usually receive the same speed set-point as an input. The torque restriction module will then act on all torque set-points output by the respective speed controllers.

Advantageously, at least one support leg's driving mechanism comprises more than one variable speed drive. This allows for distributing the jacking load. If one drive fails, at least one other will remain available. This significantly increases reliability of the support leg movement operations.

In a sophisticated embodiment, each variable speed drive of said multi-drive support leg comprises one respective torque controller connected with the respective speed controller via said bus connection. Thereby, all variable speed drives are integrated into the control system. This cascaded control structure increases reliability of the driving mechanism, because single modules and/or variable speed drives can fail without decommissioning the jacking operation. The remaining drives will simply take over the additional load.

Preferably, said bi-directional electronic bus is a high-speed field bus such as a PROFIBUS DP. The electronic bus may also be a well-known Ethernet derivative. These alternatives are low-priced, but reliable bus systems having short reaction times. FIG. 1 schematically shows an off-shore jack-up platform 1 located at sea. It comprises a hull 2 and a number of parallel, longitudinally movable support legs 3 (i.e. four, only two of them are shown). The hull 1 carries, for example, drilling equipment for oil field exploration. In the state shown in FIG. 1 all support legs 3 are set on the inclined seabed 4 as a fixed ground. The hull 1 is jacked up several meters above the water level 5.

Each support leg 3 is equipped with a driving mechanism 6 consisting of a number of respective variable speed drives, i.e. eighteen (not shown in FIG. 1), driving a rack and pinion arrangement, in combination with a closed-loop control unit (not shown in FIG. 1) common to all support legs 3. The variable speed drives of each support leg 3 are assigned, e.g. for a triangular shaped leg, to three respective groups with respective drives A to F in each group. They comprise permanent magnet motors (not shown) enabling infinitely variable speeds for driving the support legs 3. All variable speed drives $\mathbf{8}_{A1}$ (drive A of group one) to $\mathbf{8}_{F3}$ (drive F of group three) (see FIG. 2) have individual inverters (not shown).

The platform 1 can be jacked up in automatic and in manual operating mode from remote or at a local jacking console (not shown).

Figure 2:
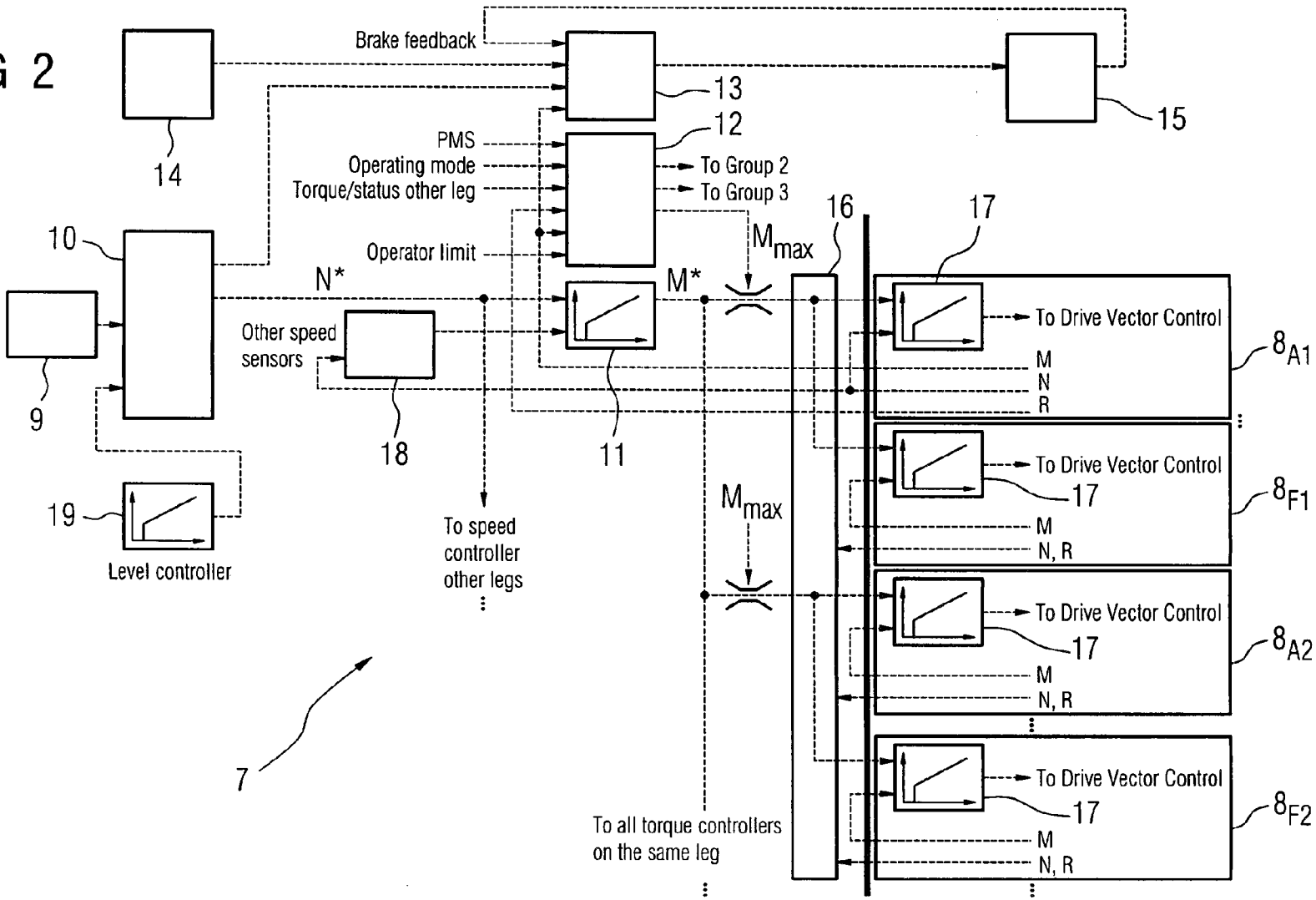
FIG. 2 shows a simplified block diagram of a driving control circuit for permanent magnet motors.

The main elements of the driving control system are shown in a simplified form in FIG. 2. It comprises a closed-loop control unit 7 and the variable speed drives $\mathbf{8}_{A1}$ (drive A of group one) to $\mathbf{8}_{F3}$ (drive F of group three) of one support leg 3 for driving e.g. a permanently excited motors (not shown) with a variable speed. Only the variable speed drives $\mathbf{8}_{A1}$, $\mathbf{8}_{F1}$, $\mathbf{8}_{A2}$ and $\mathbf{8}_{F2}$ are depicted for the sake of simplicity. For the same reason, those of the other support legs 3 are not shown in this figure, either.

The operator can, depending on the operating mode, actuate one or several levers of a lever set 9 consisting of one individual leg lever for each support leg 3 and one master lever for group operation of all support legs 3. The state of the lever set 9 is received by a speed set-point selection and correction module 10 that outputs the speed set-point N* to a respective speed controller 11 for each support leg 3 (only one speed controller 11 is shown). The speed controllers 11 output a respective torque set-point M* for the variable speed drives $\mathbf{8}_{A1}$ to $\mathbf{8}_{F2}$ assigned to them.

Besides of the speed controllers 11, the control unit 7 comprises a torque restriction module 12 and a brake control module 13 to control brakes 15. The brake control module 13 receives weight sensor values from a weight sensor validation module 14. The weight sensor validation module 14 can receive its input values either from weight cells on the support legs 3 or from a weight-on-legs estimator. The brake control module 13 also receives a feedback signal from the brake 15 it controls, and the actual torque values of all variable speed drives $\mathbf{8}_{A1}$ to $\mathbf{8}_{F2}$.

For the latter purpose, the control unit 7 is connected with the variable speed drives $\mathbf{8}_{A1}$ to $\mathbf{8}_{F2}$ via a PROFIBUS DP as a bi-directional electronic bus 16. By this electronic bus 16 connection, on the one hand, the torque set-points M* are transmitted from the respective speed controller 11 to the torque controllers 17 of each variable speed drive $\mathbf{8}_{A1}$ to $\mathbf{8}_{F2}$. On the other hand, the actual torque values M are transmitted from the variable speed drives $\mathbf{8}_{A1}$ to $\mathbf{8}_{F2}$ to the torque restriction module 12 and to the brake control module 13, and the actual speed values N are transmitted from the variable speed drives $\mathbf{8}_{A1}$ to $\mathbf{8}_{F2}$ to a respective speed sensor validation module 18 disposed upstream of the speed controllers 11. Besides, flags R signalling the drives' states "running" or "stopped" are transmitted from each variable speed drive $\mathbf{8}_{A1}$ to $\mathbf{8}_{F2}$ to the torque restriction module 12. For the sake of clearness of the drawing, the transmission of the actual values N, M and R from variable speed drives $\mathbf{8}_{F1}$, $\mathbf{8}_{A2}$, $\mathbf{8}_{F2}$ via the electronic bus 16 are sketched only. This also applies for the torque limitation imposed by the torque restriction module 12 on drive groups two and three.

Because during jacking operations several components can be out of order, the weight sensor validation module 14 and the speed sensor validation modules 18 evaluate the status and values of their input sensors based on a control strategy. They may select the most probable correct value, which either is a maximum, a mean, a low selection or a calculated average value from functional sensors. They may also select sensors with the highest bandwidth. For example, the speed sensor validation modules 18 can use speed values from the motors rather than calculated speed values from position sensors. Other sensors may be provided as alternatives, too. Brake feedback input to the brake control module 13 may be signalled from locking/clamping mechanism.

Each speed controller 11 generates a torque set-point to all of its downstream variable speed drives $\mathbf{8}_{A1}$ to $\mathbf{8}_{F2}$. This set-point can be clamped down by superior control structures, such as the power management system PMS or operator-set limits, which is executed by the torque restriction module 12. Any difference between the support legs are automatically adjusted by the level controller 19 having information about the position and deviation of each support leg 3. Differences between the variable speed drives $\mathbf{8}_{A1}$ to $\mathbf{8}_{F2}$ of the same support leg 3 are adjusted by the torque restriction module 12 performing the torque set-point clamping. The restriction is performed before the torque set-point M* is given to the bus 16.

Figure 3:
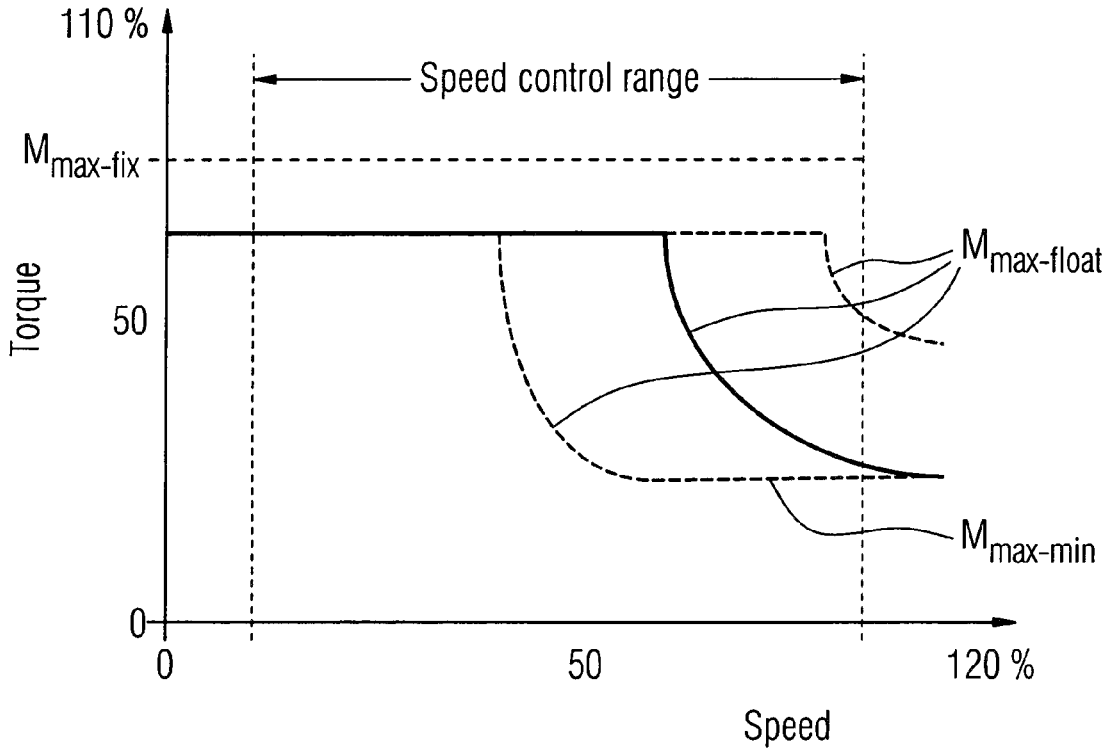
FIG. 3 shows a schematic torque-speed diagram for torque limitation.

A torque-speed diagram describing two different limitation strategies is shown schematically in FIG. 3.

Depending on the state flags R and the actual torque values M of all variable speed drives $\mathbf{8}_{A1}$ to $\mathbf{8}_{F2}$ as well as input from a power management system PMS and the selected operating mode, the torque restriction module 12 can limit the torque set-points M* output by the speed controllers 11 to a maximum torque $M_{max\text{-}fix}$ in the first strategy.

Power limitation is a recommended feature to prevent a possible black-out during a jacking operation. For specific applications, it is necessary to limit the output to predefinable values. For simple applications, this can be achieved using a fixed torque limit. For this purpose, the outputs of the speed controllers 11 are monitored by the torque restriction module 12 and, if necessary, restricted to the limit values, in addition to an effective current limit. As a consequence, the maximum output is also limited corresponding to the maximum torque at the maximum speed.

In many cases, a permanently set torque limit $M_{max\text{-}fix}$ is not sufficient to provide an effective power limit. For example, the fact that the torque limit must be set appropriately high with respect to having a high breakaway torque can cause the maximum permissible output to be exceeded at high speeds. Also in induction motor cases where the induction motor field weakening operation is used, an effective output limit can only be achieved using a fixed torque limit $M_{max\text{-}fix}$ in specific cases.

Therefore, an advantageous second strategy is a combined torque/power limitation performed by the torque restriction module 12. During low speed situations, a torque limit $M_{max\text{-}low}$ determined internally or externally will limit the torque set-points M* output by the speed controllers 11. During high-speed situations, the actual power limit will be taken into account as a floating limit $M_{max\text{-}float}$ based on available power on the platform 1. This will be the torque that can be achieved when limiting to the rated drive converter current. The torque limit will always be greater than a predefinable minimum torque limit $M_{max\text{-}min}$.

Besides of the operating modes "automatic" and "manual", the control unit 7 offers several control modes to the operator. Their functioning is described in the following.

The automatic operating mode is designed to operate all support legs 3 simultaneously at the same speed apart from individual corrections. It also provides an automatic level control when raising or lowering the platform 1. The level control function is to be enabled manually by the operator by using a push-button from local or remote position for this purpose.

For lifting the platform 1, i.e. the hull 2, the level control function should be enabled by the operator. This will adjust the speed of the legs' movement to maintain the balance of the platform 1. The speed is automatically limited to a maximum of e.g. 2 m/min and is a function of the deflection of the master lever of the lever set 9. If the master lever is released it will return to a neutral position and the jacking speed goes back to zero. The brakes 15 will be automatically engaged at a predefinable time later. In any phase of the operation, the individual leg speed can be adjusted, i.e. be increased or decreased, via the corresponding individual lever. The support legs 3 work in unison, e.g. upon a leg failure or shutoff action by the operator, the others will stop. In any of these cases the brakes 15 will be engaged immediately.

The procedure to lower the hull 2 is similar to lifting, but in reverse order. With the motion of the master lever downwards, the platform 1 is lowered. The calculated load will show a negative value as the torque is negative. The speed of platform 1 lowering is limited, even at maximum lever deflection, to e.g. 2 m/min. Once the platform 1 reaches the water level the load indication will tend towards positive as the torque becomes less negative. The level control function should then be switched off for leg lifting.

The holding function can be selected from the jacking console by pushing a "Holding" push-button on the console. This will override the automatic braking function during platform lifting and lowering when the master lever reaches its neutral position. During this operation, the temperature within the motors will increase. As the motor temperatures are permanently monitored, this function will be automatically disabled and the brakes 15 are engaged if a given number of motor temperature warning limits are exceeded.

With the platform 1 in a semi-elevated position, possibly so-called spud cans momentarily stuck to the seabed 4, and the operator holding the master lever down, the leg lifting speed increases as the support legs 3 leave the seabed 4. The speed is still proportional to the deflection of the master lever, but in this case to a maximum of e.g. 3 m/min. The operator will stop the operation when the legs are in tow position. This position can be preset or defined on a visual display unit (VDU). If it is not defined or overridden the system will automatically stop the lifting action when the limit switches of the support legs 3, signalling "end position achieved", are activated. To position them independently, the support legs 3 can be moved in manual mode.

For leg lowering, the individual legs are enabled by push-buttons. The operation is started by deflecting the master lever to the "up" direction, which means lifting the hull 2, i.e. lowering the support legs 3. The lowering speed is proportional to the deflection of the master lever. Maximum speed is e.g. 3 m/min in this case. All support legs 3 are lowered at the same speed. The load meters will show a negative value.

When at least one of the support legs 3 touches the ground, i.e. the seabed 4, the lowering speed decreases until it reaches zero, and the torque will increase to e.g. an approximate value of 30% with a maximum torque value which is given by design requirements. This torque value is adjustable by the operator. This is maintained until all support legs 3 achieve the same state. Once all support legs 3 are in position, the torque limit $M_{max}$ will be increased gradually. During this transition period, the support legs 3 can move at different speeds due to seabed conditions. With the raising of the torque limit $M_{max}$, the variable speed drives 8 are returning to speed control for lifting the hull 2.

The manual operating mode is designed to leave the control of each individual support leg 3 up to the operator. The speed depends on the respective individual leg lever position. The automatic level control is not functioning in this operating mode.

The manual operating mode allows more freedom for adjustments to the operator, such as pre-loading or making individual position adjustments to the support legs 3, e.g., when the seabed is known to be inclined. Certain restrictions apply to this mode, namely the absence of power limitation from the jacking console, no torque limitation other than the maximum allowed by the variable speed drives 8 and no automatic level control other than by personally reading inclinometers.

To pre-load, the platform 1 must already be elevated on all support legs 3. Therefore, the operator must select e.g. two out of the diagonally opposed support legs 3 and raise them to partially unload them. This is done by putting the system in a "manual" operating mode and selecting the two support legs 3 using the respective "enable" push-buttons. They are raised (or slightly unloaded) using the master lever in the proper direction. This causes the weight of the platform 1 to rest on the other two support legs 3, thus pushing the pre-loaded pair into the seabed 4. For the pre-loading of the other pair of support legs 3, the operation is repeated after repositioned the platform 1 above the sea.

To extract one support leg 3 from the seabed 4 a maximum torque may be required for a period of time. By selecting this function all other torque limits are overridden except for the limit calculated by the power management system PMS. However, in this operating mode there occur speeds close to zero, and the power consumed is less than during platform lifting operations at full speed.

The actual torque M and actual speed N are constantly monitored. When a support leg 3 starts moving and the actual torque M is reduced, the control unit 7 reduces the torque set-point gradually to avoid a sudden "leg out of seabed" event. This reduction can be either performed by the speed controllers 11 or in the form of a torque limit $M_{max}$ by the torque restriction module 12. Ordinarily for heavy operations water jets might be used to assist retraction of legs 3.

A variable frequency drive control for induction motors can be arranged following the same principles as shown above, however, applying slight modifications known to a person skilled in the art.

The invention claimed is:

1. A drive control system for controlling the movement of a support leg of a jack-up platform, the drive control system comprising:

at least one variable speed drive for driving a driving mechanism of the support leg with variable speed, the variable speed drive being coupled to a torque controller; and a control unit for controlling the variable speed drive, the control unit comprising a speed controller configured to transmit a torque set-point to the torque controller of the variable speed drive to enable a torque control of the movement of the support leg.

2. The drive control system according to claim 1, wherein the variable speed drive is coupled to a permanently excited motor.

3. The drive control system according to claim 1, wherein the variable speed drive is coupled to an induction motor.

4. The drive control system according to claim 1, wherein the control unit comprises bi-directional bus which couples the speed controller to the torque controller of the variable speed drive, the speed controller being configured to hand over the torque set-point to the torque controller via the bi-directional bus.

5. The drive control system according to claim 1, wherein the control unit is a closed loop control unit.

6. The drive control system according to claim 5, wherein the torque controller of the variable speed drive is adapted to transmit an actual torque value of the variable speed drive to the control unit.

7. The drive control system according to claim 1, wherein the torque controller is integrated into the variable speed drive.

8. The drive control system according to claim 1, wherein said speed controller is adapted to receive an actual speed value of said variable speed drive.

9. The drive control system according to claim 1, wherein the control unit comprises a speed sensor validation module that is disposed upstream of said speed controller.

10. The drive control system according to claim 9, wherein said speed sensor validation module selects at least one of a most probable correct speed value and a speed value of a highest-bandwidth sensor.

11. The drive control system according to claim 1, wherein the control unit comprises a torque restriction module acting on said torque set-point output by said speed controller to the torque controller of the variable speed drive.

12. The drive control system according to claim 11, wherein said torque restriction module is configured to perform a combined torque/power limitation.

13. The drive control system according to claim 11, wherein said torque restriction module is configured to receive actual speed and actual torque values of said variable speed drive.

14. The drive control system according to claim 1, wherein the control unit comprises one respective speed controller for each support leg of the jack-up platform.

15. The drive control system according to claim 1, wherein the drive control system comprises more than one variable speed drive for the support leg.

16. The drive control system according to claim 15, wherein each variable speed drive for driving the support leg comprises one respective torque controller, the torque controllers of the variable speed drives of the support leg being connected with the respective speed controller of the support leg via a bi-directional bus connection.

17. The drive control system according to claim 4, wherein the bi-directional electronic bus is a high-speed field bus or an Ethernet.

* * * * *